US005265431A

United States Patent [19]

Gaudet et al.

[11] Patent Number: 5,265,431

[45] Date of Patent: Nov. 30, 1993

[54] ELECTRONICALLY CONTROLLED CRYOPUMP AND NETWORK INTERFACE

[75] Inventors: Peter W. Gaudet, Allston; Paul E. Amundsen, Ipswich, both of Mass.

[73] Assignee: Helix Technology Corporation, Mansfield, Mass.

[21] Appl. No.: 936,564

[22] Filed: Aug. 27, 1992

Related U.S. Application Data

[62] Division of Ser. No. 717,085, Jun. 18, 1991, Pat. No. 5,176,004.

[51] Int. Cl.[5] ..... B01D 8/00

[52] U.S. Cl. ..... 62/55.5; 62/126

[58] Field of Search ..... 62/55.5, 126

[56] References Cited

U.S. PATENT DOCUMENTS

| | | | |
|---|---|---|---|
| 4,918,930 | 4/1990 | Gaudet et al. | 62/55.5 |
| 4,970,870 | 11/1990 | Midlang et al. | 62/126 |
| 5,010,737 | 4/1991 | Okumura et al. | 62/55.5 |

OTHER PUBLICATIONS

Brown, Thomas G. et al., "Microcomputer Applications In The Space Simulation Laboratory," *Proceedings—Institute of Environmental Sciences*, 1983, pp. 179–188.

Finley, Laurence, "Automatic regeneration of multiple cryopumps" *J. Vac. Sci. Technol.* A4(3), May/Jun. 1986, American Vacuum Society, pp. 310–313.

*Primary Examiner*—Ronald C. Capossela

*Attorney, Agent, or Firm*—Hamilton, Brook, Smith & Reynolds

[57] ABSTRACT

A network of cryopumps, each having an electronic regeneration controller, is coupled to a common rough pump. Each regeneration controller operates independently except that each is inhibited from opening its roughing valve to the common rough pump. Each regeneration controller only proceeds to open the roughing valve after it has received a token from a network interface terminal. The network interface terminal may control multiple groups of cryopumps coupled to respective common rough pumps. The regeneration controllers are removable modules connected to the cryopumps. A PROM is provided for each cryopump to the side of the connector opposite to the module. The PROM stores data specific to the cryopump and retains the data for the cryopump with replacement of the controller module.

6 Claims, 7 Drawing Sheets

ELECTRONICALLY CONTROLLED CRYOPUMP AND NETWORK INTERFACE

This application is a division of application Ser. No. 07/717,085, filed on Jun. 18, 1991, U.S. Pat. No. 5,176,004.

BACKGROUND OF THE INVENTION

Cryogenic vacuum pumps, or cryopumps, currently available generally follow a common design concept. A low temperature array, usually operating in the range of 4 to 25K, is the primary pumping surface. This surface is surrounded by a higher temperature radiation shield, usually operated in the temperature range of 60 to 130K, which provides radiation shielding to the lower temperature array. The radiation shield generally comprises a housing which is closed except at a frontal array positioned between the primary pumping surface and a work chamber to be evacuated.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, only a vacuum remains in the work chamber.

In systems cooled by closed cycle coolers, the cooler is typically a two-stage refrigerator having a cold finger which extends through the rear or side of the radiation shield. High pressure helium refrigerant is generally delivered to the cryocooler through high pressure lines from a compressor assembly. Electrical power to a displacer drive motor in the cooler is usually also delivered through the compressor.

The cold end of the second, coldest stage of the cryocooler is at the tip of the cold finger. The primary pumping surface, or cryopanel, is connected to a heat sink at the coldest end of the second stage of the cold finger. This cryopanel may be a simple metal plate or cup or an array of metal baffles arranged around and connected to the second-stage heat sink. This second-stage cryopane also supports the low temperature adsorbent.

The radiation shield is connected to a heat sink, or heat station, at the coldest end of the first stage of the refrigerator. The shield surrounds the second-stage cryopanel in such a way as to protect it from radiant heat. The frontal array is cooled by the first-stage heat sink through the side shield or, as disclosed in U.S. Pat. No. 4,356,701, through thermal struts.

After several days or weeks of use, the gases which have condensed onto the cryopanels, and in particular the gases which are adsorbed, begin to saturate the system. A regeneration procedure must then be followed to warm the cryopump and thus release the gases and remove the gases from the system. As the gases evaporate, the pressure in the cryopump increases, and the gases are exhausted through a relief valve. During regeneration, the cryopump is often purged with warm nitrogen gas. The nitrogen gas hastens warming of the cryopanels and also serves to flush water and other vapors from the system. By directing the nitrogen into the system close to the second-stage array, the nitrogen gas which flows outward to the exhaust port prevents the flow of water vapor from the first array back to the second-stage array. Nitrogen is the usual purge gas because it is inert, and it is usually delivered from a nitrogen storage bottle through a fluid line and a purge valve coupled to the cryopump.

After the system is purged, it must be rough pumped to produce a vacuum about the cryopumping surfaces and cold finger to reduce heat transfer and thus enable the cryocooler to cool to cryogenic temperatures. The rough pump is generally a mechanical pump coupled through a fluid line to a roughing valve mounted to the cryopump.

Control of the regeneration process is facilitated by temperature gauges coupled to the cold finger heat stations. Thermocouple pressure gauges have also been used with cryopumps. The temperature and/or pressure sensors mounted to the pump are coupled through electrical leads to temperature and/or pressure indicators.

Although regeneration may be controlled by manually turning the cryocooler off and on and manually controlling the purge and roughing valves, a separate regeneration controller is used in more sophisticated systems. Leads from the controller are coupled to each of the sensors, the cryocooler motor and the valves to be actuated. U.S. Pat. No. 4,918,930 presents an electronically controlled cryopump in which the regeneration controller is contained within a removable module which may be connected integrally with the cryopump.

DISCLOSURE OF THE INVENTION

One aspect of the present invention relates to a network of cryopumps, each having a roughing valve. The plural roughing valves may be coupled to a common rough pump. A plurality of programmable regeneration controllers are also provided, each coupled to a cryopump to control a regeneration cycle of the cryopump. The regeneration cycle includes opening of the roughing valve to the rough pump in order to rough the cryopump. The regeneration controllers may be integral with the cryopump as in U.S. Pat. No. 4,918,930.

In accordance with the present invention, each regeneration controller is inhibited from opening its respective roughing valve when another roughing valve is open to a common rough pump. Specifically, a central controller monitors requirements of the individual regeneration controllers for rough pumping.

The central controller may also control other roughing valves such as valves couples to process chambers. The central controller may oversee several groups of cryopumps coupled to several rough pumps.

Each regeneration controller may respond to an individual input to set a roughing valve interlock. With that interlock set, the regeneration controller will not open the associated roughing valve until it obtains permission from the central controller. The central controller may provide that permission by transmitting a token to a requesting cryopump. Only one token is permitted per group of cryopumps coupled to a rough pump. Where the interlock is not set, the regeneration controller will not require permission to proceed with opening of the roughing valve. For example, the interlock may not be set if a single cryopump is coupled to a rough pump.

Another aspect of the invention relates to the electronics associated with each cryopump. The programmable electronic processor which controls operation of the cryopump is mounted in a removable module which is coupled to the cryopump through a connector. The module may be integral with the cryopump as in U.S. Pat. No. 4,918,930 or be coupled to the cryopump through cables. In either case, a nonvolatile memory is coupled to the cryopump to the side of the connector opposite to the module. The electronic processor communicates with the memory device through the connector. With this configuration, the nonvolatile memory device remains with the cryopump even as the electronic module is replaced. The memory device may therefore retain information unique to the cryopump with replacement of the module for servicing or upgrade. For example, the module may include calibration data, regeneration and relay parameters previously programmed into the controller by a user and historical data for the particular cryopump.

Preferably the nonvolatile memory device is an electrically erasable and programmable read only memory EEPROM so that the data may be modified by the processor of the regeneration controller. To minimize lines passing through the connector, the device is preferably accessed through a serial data line. To back up the RAM in the module, another electrically writable PROM is provided on the module. However, that PROM is preferably a faster device having parallel data access such as a FLASH device.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts through different views. The drawings are not necessarily to scale, emphasis being placed instead upon illustrating the principles of the invention.

DESCRIPTION OF A PREFERRED EMBODIMENT

Figure 1:
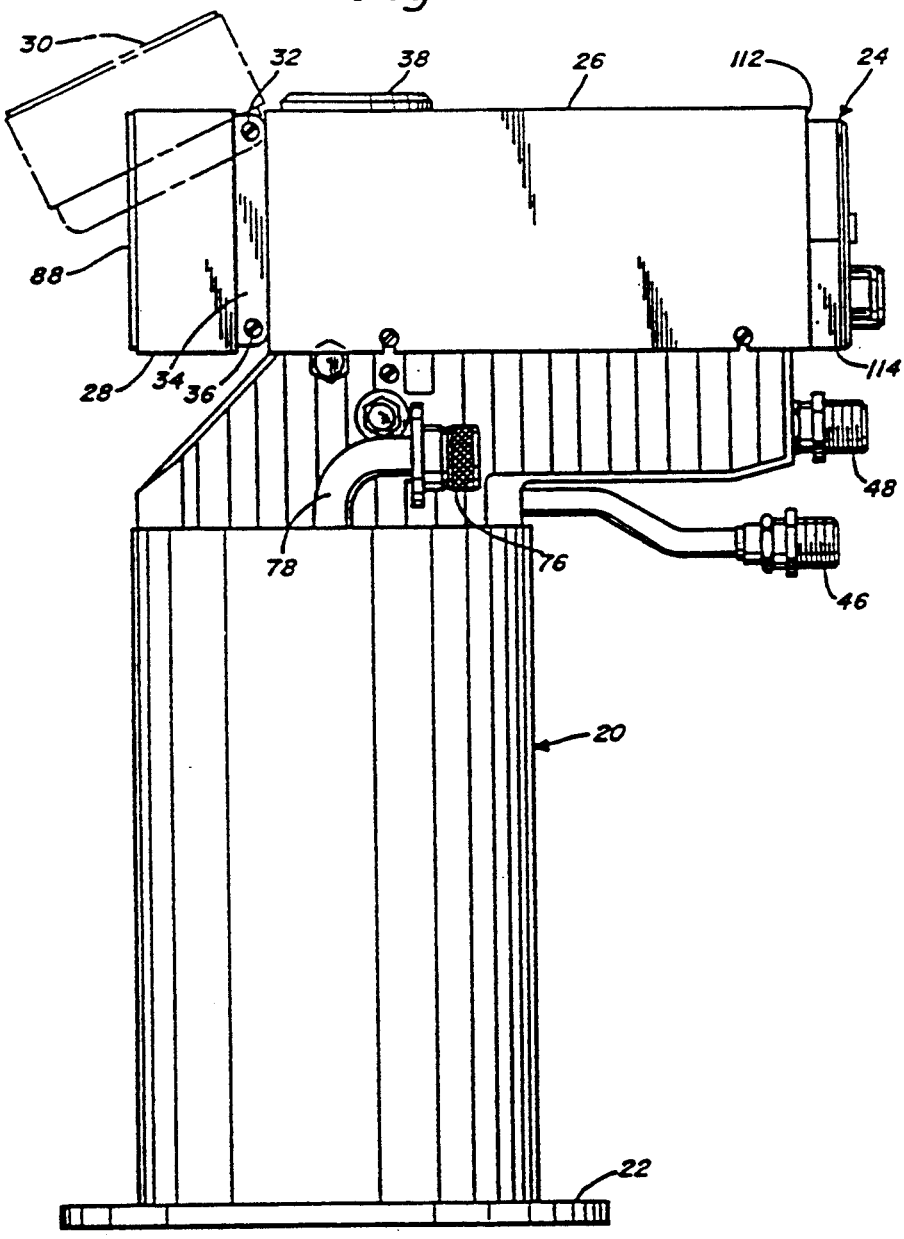
FIG. 1 is a side view of a cryopump embodying the present invention.

FIG. 1 is an illustration of a cryopump embodying the present invention. The cryopump includes the usual vacuum vessel 20 which has a flange 22 to mount the pump to a system to be evacuated. The cryopump includes an electronic module 24 in a housing 26 at one end of the vessel 20. A control pad 28 is pivotally mounted to one end of the housing 26. As shown by broken lines 30, the control pad may be pivoted about a pin 32 to provide convenient viewing. The pad bracket 34 has additional holes 36 at the opposite end thereof so that the control pad can be inverted where the cryopump is to be mounted in an orientation inverted from that shown in FIG. 1. Also, an elastomeric foot 38 is provided on the flat upper surface of the electronics housing 26 to support the pump when inverted.

Figure 2:
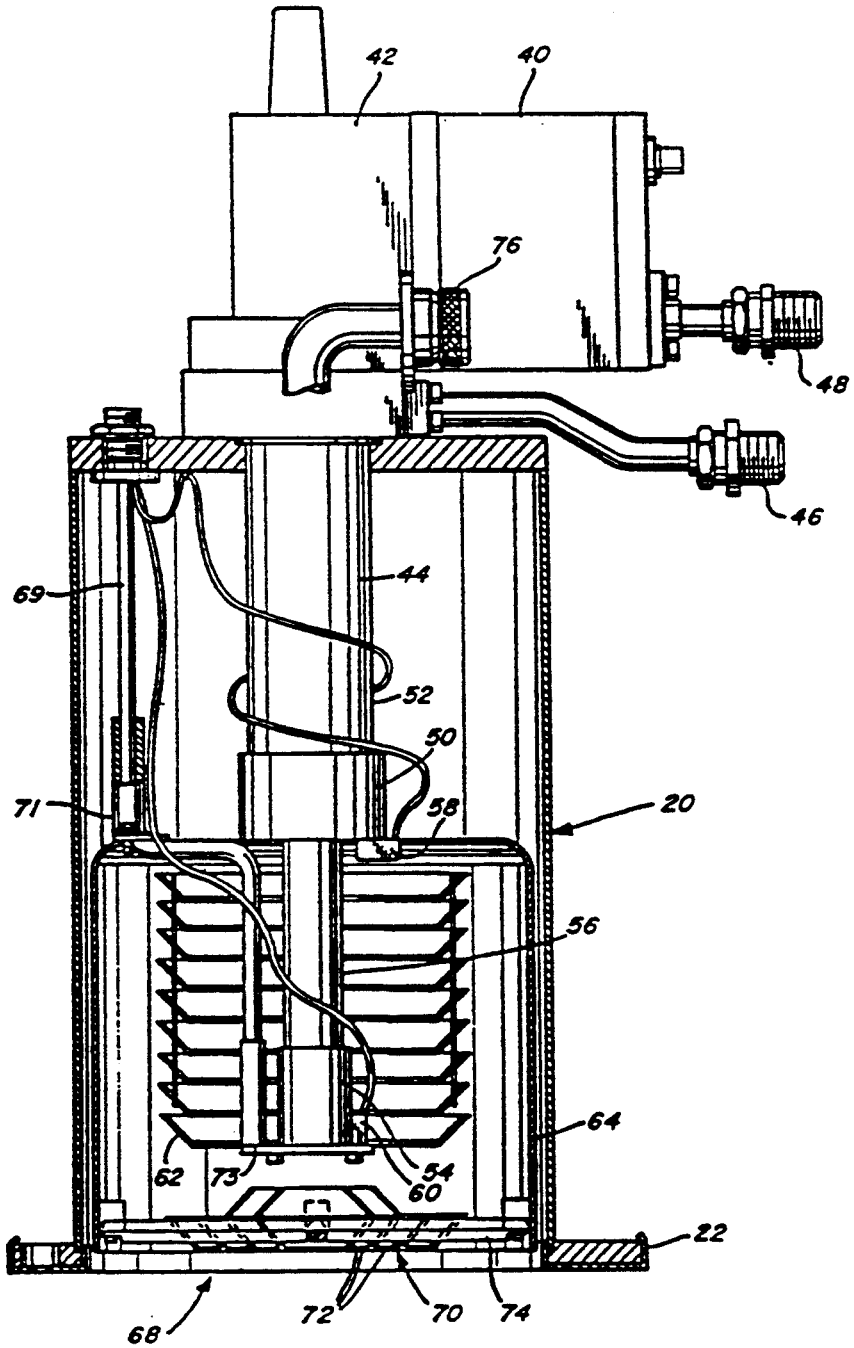
FIG. 2 is a cross-sectional view of the cryopump of FIG. 1 with the electronic module and housing removed.

As illustrated in FIG. 2, much of the cryopump is conventional. In FIG. 2, the housing 26 is removed to expose a drive motor 40 and a crosshead assembly 42. The crosshead converts the rotary motion of the motor 40 to reciprocating motion to drive a displacer within the two-stage cold finger 44. With each cycle, helium gas introduced into the cold finger under pressure through line 46 is expanded and thus cooled to maintain the cold finger at cryogenic temperatures. Helium then warmed by a heat exchange matrix in the displacer is exhausted through line 48.

A first-stage heat station 50 is mounted at the cold end of the first stage 52 of the refrigerator. Similarly, heat station 54 is mounted to the cold end of the second stage 56. Suitable temperature sensor elements 58 and 60 are mounted to the rear of the heat stations 50 and 54.

The primary pumping surface is a cryopanel array 62 mounted to the heat sink 54. This array comprises a plurality of disks as disclosed in U.S. Pat. No. 4,555,907. Low temperature adsorbent is mounted to protected surfaces of the array 62 to adsorb noncondensible gases.

A cup-shaped radiation shield 64 is mounted to the first stage heat station 50. The second stage of the cold finger extends through an opening in that radiation shield. This radiation shield 64 surrounds the primary cryopanel array to the rear and sides to minimize heating of the primary cryopanel array by radiation. The temperature of the radiation shield may range from as low as 40° K at the heat sink 50 to as high as 130° K adjacent to the opening 68 to an evacuated chamber.

A frontal cryopanel array 70 serves as both a radiation shield for the primary cryopanel array and as a cryopumping surface for higher boiling temperature gases such as water vapor. This panel comprises a circular array of concentric louvers and chevrons 72 joined by a spoke-like plate 74. The configuration of this cryopanel 70 need not be confined to circular, concentric components; but it should be so arranged as to act as a radiant heat shield and a higher temperature cryopumping panel while providing a path for lower boiling temperature gases to the primary cryopanel.

Figure 3:
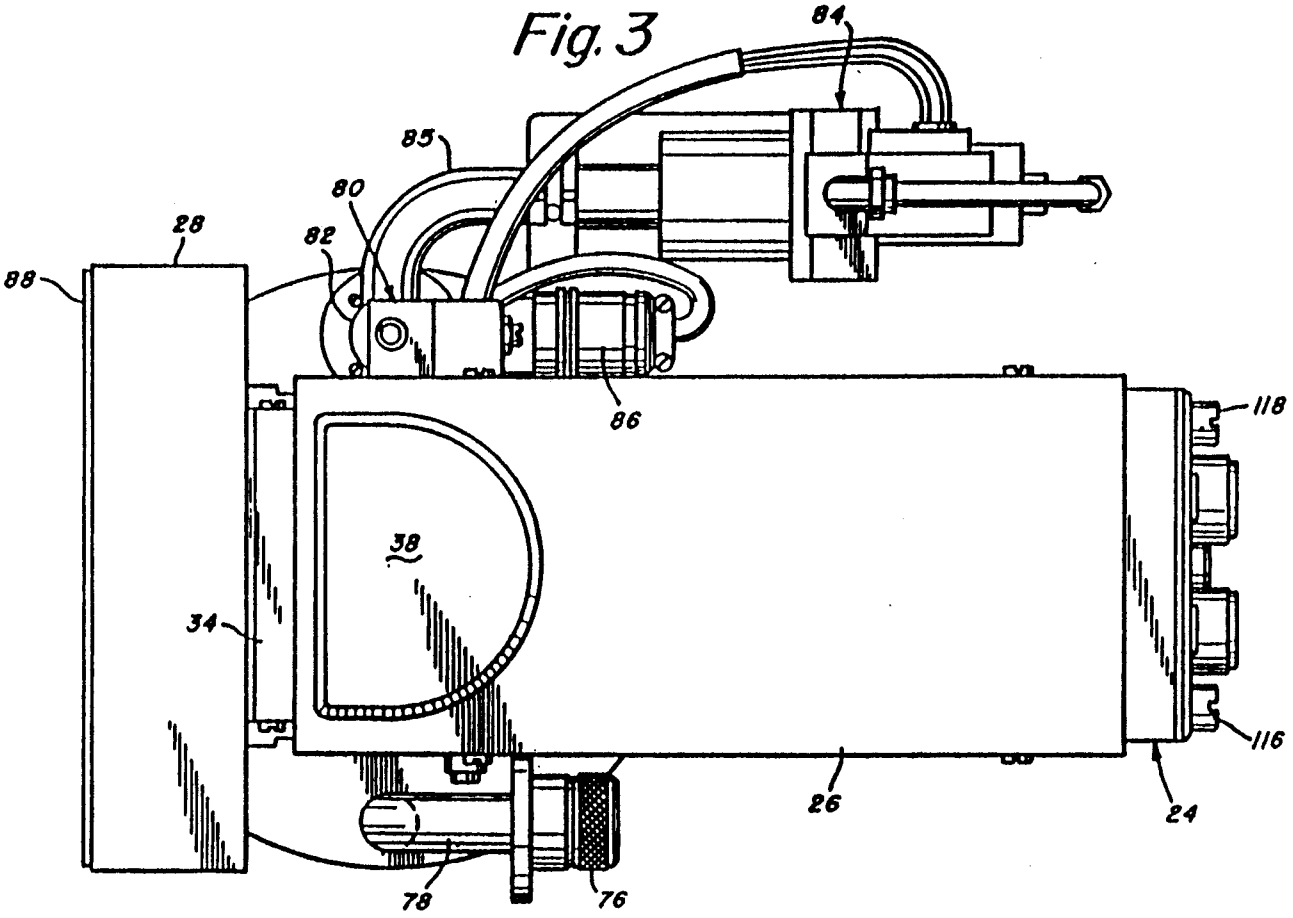
FIG. 3 is a top view of the cryopump of FIG. 1.

As illustrated in FIGS. 1 and 3, a pressure relief valve 76 is coupled to the vacuum vessel 20 through an elbow 78. To the other side of the motor and the electronics housing 26, as illustrated in FIG. 3, is an electrically actuated purge valve 80 mounted to the housing 20 through a vertical pipe 82. Also coupled to the housing 20 through the pipe 82 is an electrically actuated roughing valve 84. The valve 84 is coupled to the pipe 82 through an elbow 85. Finally, a thermocouple vacuum pressure gauge 86 is coupled to the interior of the chamber 20 through the pipe 82.

Less conventional in the cryopump is a heater assembly 69 illustrated in FIG. 2. The heater assembly includes a tube which hermetically seals electric heating units. The heating units heat the first stage through a heater mount 71 and a second stage through a heater mount 73.

As will be discussed in greater detail below, the refrigerator motor 40, cryopanel heater assembly 69, purge valve 80 and roughing valve 84 are all controlled by the electronic module. Also, the module monitors the temperature detected by temperature sensors 58 and 60 and the pressure sensed by the TC pressure gauge 86.

Figure 4:
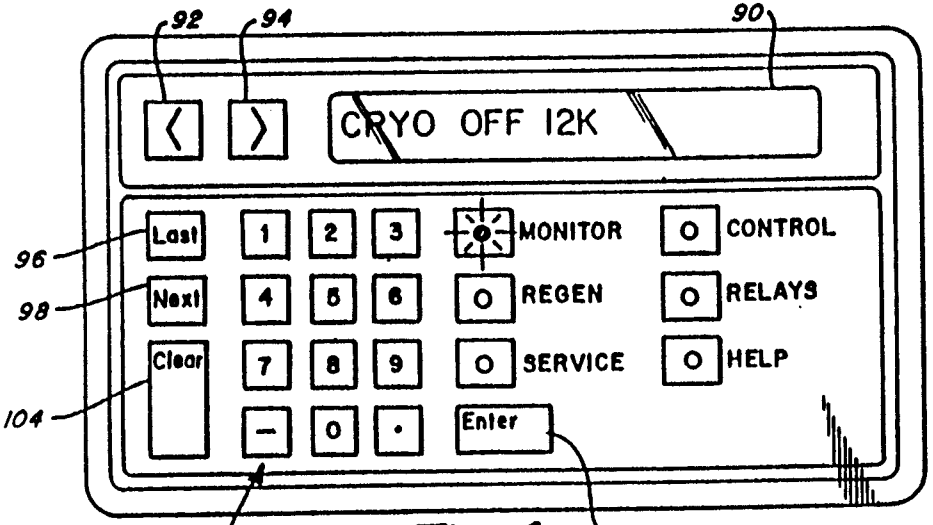
FIG. 4 is a view of the control panel of the cryopump of FIGS. 1 and 3.

The control pad 28 has a hinged cover plate 88 which, when opened, exposes a keyboard and display illustrated in FIG. 4. The control pad provides the means for programming, controlling and monitoring all cryopump functions. It includes an alphanumeric display 90 which displays up to sixteen characters. Longer messages can be accessed by the horizontal scroll display keys 92 and 94. Additional lines of messages and menu items may be displayed by the vertical scroll display keys 96 and 98. Numerical data may be input to the system by keys 100. The ENTER and CLEAR keys 102 and 104 are used to enter and clear data during programming. A MONITOR function key allows the display of sensor data and on/off status of the pump and relays. A CONTROL function key allows the operator to control various on and off functions. The RELAYS function key allows the operator to program the opening and closing of two set point relays. The REGEN function key activates a complete cryopump regeneration cycle, allows regeneration program changes and sets power failure recovery parameters. The SERVICE function key causes service-type data to be displayed and allows the setting of a password and password lockout of other functions. The HELP function key provides additional information when used in conjunction with the other five keys. Further discussion of the operation of the system in response to the function keys is presented below.

Figure 5:
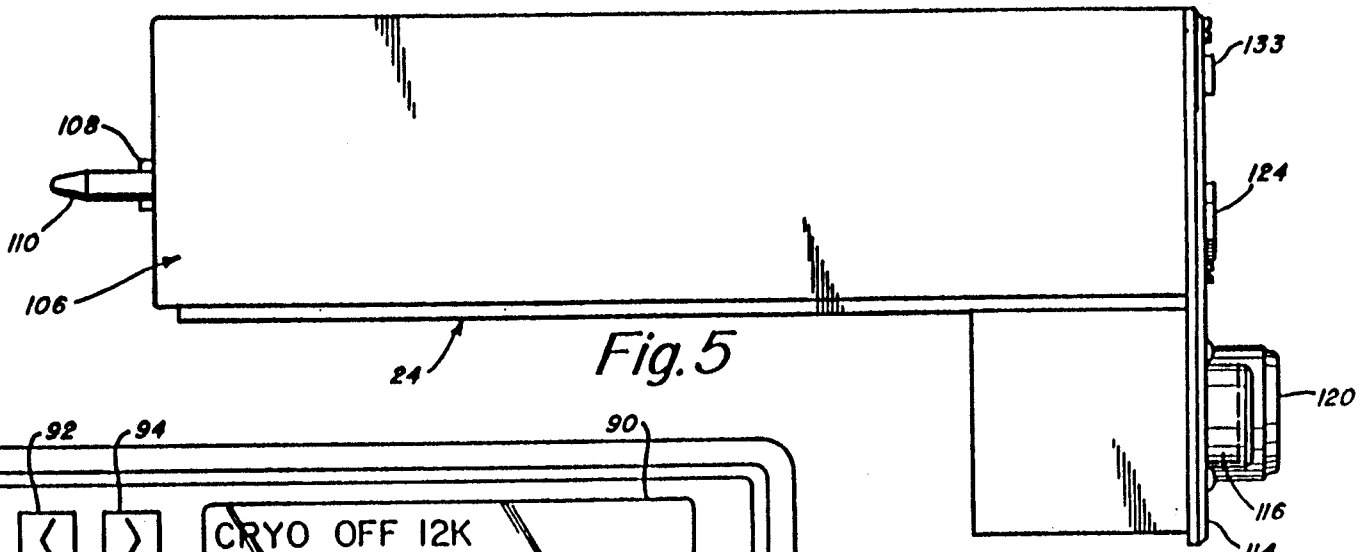
FIG. 5 is a side view of an electronic module removed from the cryopump of FIGS. 1 and 3.
Figure 6:
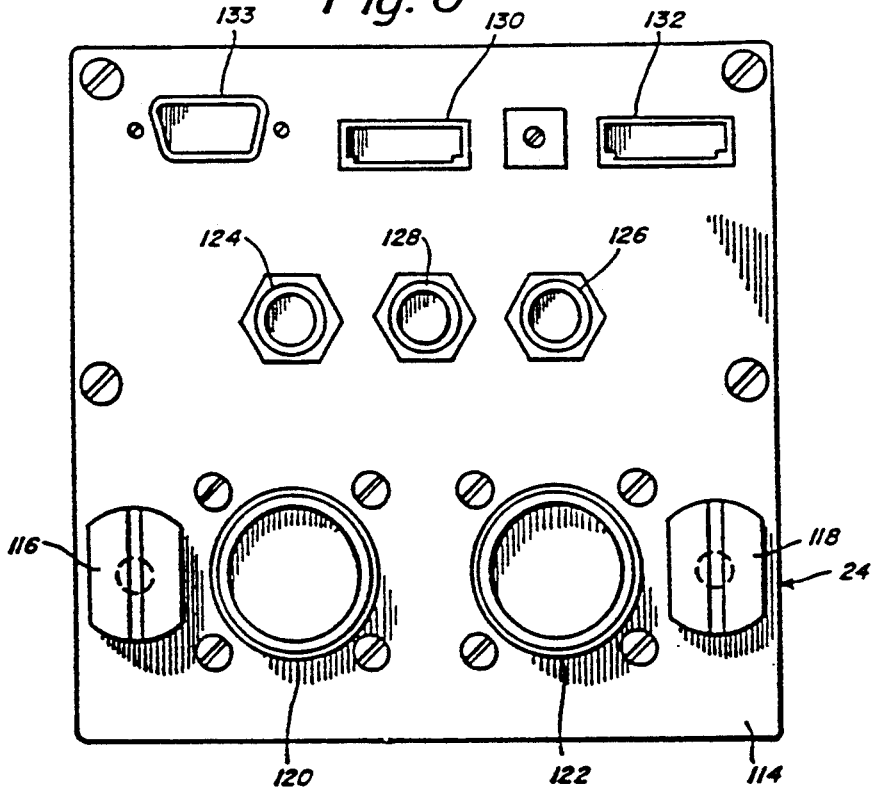
FIG. 6 is an end view of the module of FIG. 5.

In accordance with the present invention, all of the control electronics required to respond to the various sensors and control the refrigerator, heaters and valves are housed in a module 106 illustrated in FIG. 5. A control connector 108 is positioned at one end of the module housing. It is guided by a pair of pins 110 into association with a complementary connector within the permanently mounted housing 26. All electric access to the fixed elements of the cryopump is through this connector 108. The module 106 is inserted into the housing 26 through an end opening at 112 with the pins 110 leading. The opposite, external connection end 114 of the module is left exposed. That end is illustrated in FIG. 6.

Once the module is secured within the housing 26 by screws 116 and 118, power lines may be coupled to the input connector 120 and an output connector 122. The output connector allows a number of cryopumps to be connected in a daisy chain fashion as discussed below. Due to the elongated shape of the heads of the screws 116 and 118, those screws may not be removed until the power lines have been disconnected.

Also included in the end of the module is a connector 124 for controlling external devices through relays in the module and a connector 126 for receiving inputs from an auxiliary TC pressure sensor. A connector 128 allows a remote control pad to be coupled to the system. Connectors 130 and 132 are incoming and outgoing communications ports for coupling the pump into a network. An RS 232 port 133 allows access and control from a remote computer terminal, directly or through a modem.

A detailed discussion of user programming of the system through the keypad is presented in U.S. Pat. No. 4,918,930. Each cryopump can be programmed to independently perform an individual regeneration cycle.

Figure 7:
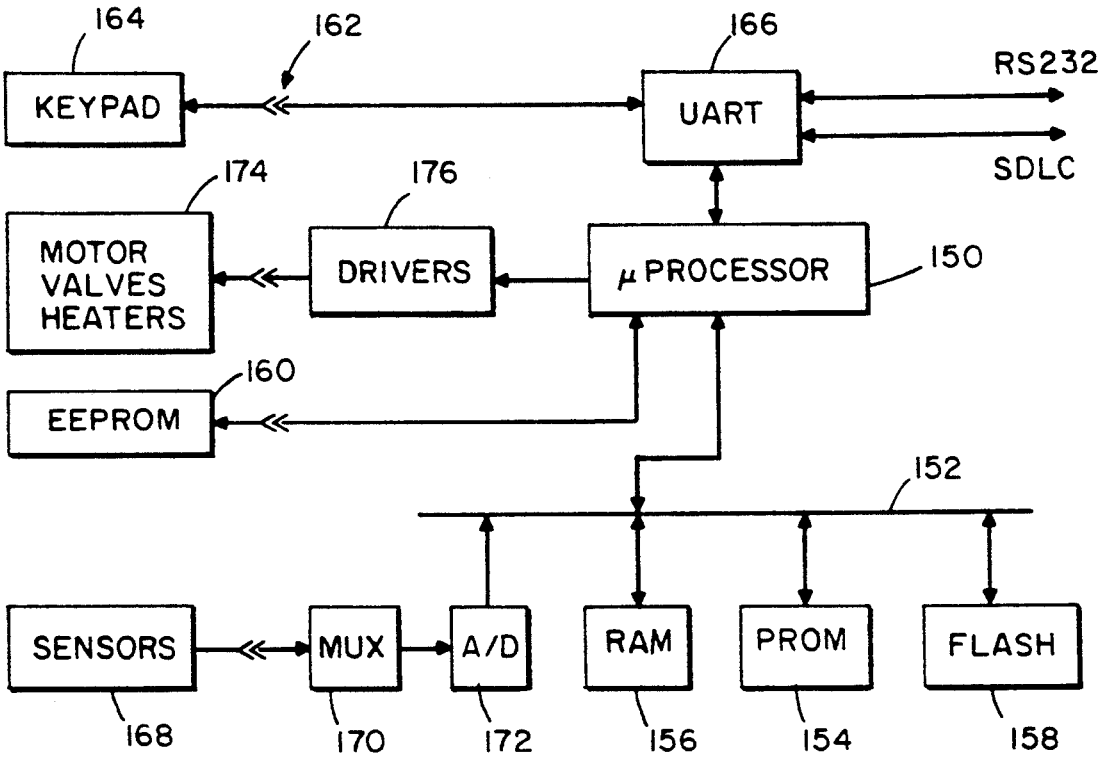
FIG. 7 is a block diagram of the regeneration controller electronics in the cryopump electronics module.

FIG. 7 provides a block diagram of the electronics module and its connections to the cryopump. A microprocessor 150 is an Intel 8344 microprocessor. It communicates with memory along a data bus 152. Memory includes a programmable read only memory 154 which carries the system firmware and a RAM 156 which serves as a scratch pad memory and carries system serial numbers, programmable parameters, diode characteristics, diagnostic information and user configurable information. The RAM is a battery backed RAM to prevent loss of data with power loss. However, the system may be used in a noisy environment which can cause loss of data stored in the RAM. Therefore, a backup memory 158 is provided. Memory 158 is a FLASH PROM. A FLASH memory may erasable and writable to by the microprocessor 150. Though the microprocessor generally operates through the RAM, it does copy into the FLASH device 158 information required by the system in the event of loss of data from the RAM. That information includes calibration values and serial numbers for the temperature sensing diodes in the cryopump, regeneration and relay parameters programmed into the system by a user through the keypad, the cryopump serial number and historial data including the elapsed time of operation of the cryopump and the time since last regeneration.

With replacement of an electronics module for repair or upgrade, the data stored in memory elements 154, 156 and 158 which is unique to a particular cryopump or which has been configured into a cryopump by the user would in past systems have to be transferred to the new module. This required a service technician and a computer programmed to perform the function. If the information was not transferred then the cryopump might not operate properly and the information regarding the operating history of the pump would not be available at the pump. In accordance with the present invention, an addition PROM 160 is provided. That PROM is positioned on the cryopump side of a connector 162 so it always remains with the cryopump even with replacement of the electronics module. To minimize the data lines through the connector, the PROM 160 preferably has serial data access. To allow storage of the user configuration and historical data, the PROM 160 is also electrically erasable and writable and is preferably a conventional EEPROM. Much of the data stored in the FLASH PROM 158 is copied into the EEPROM 160. However, to allow for use of a smaller memory device 160, only a limited amount of historical data is copied into that PROM.

The keypad 164 and display 162 is coupled to the microprocessor 150 through an RS 232 port and a universal asynchronous receive and transmit (UART) module 166. The UART 166 also couples the microprocessor 150 to an external RS 232 port for communication with a host computer and an SDLC multidrop port for networking of cryopumps. Analog sensor inputs from the first and second stage temperature sensors, the internal thermocouple gauge and an auxiliary thermocouple gauge, shown generally as inputs 168, are coupled through a multiplexer 170 to an analog to digital converter 172 which transfers the digital sensor data to the bus 152 and microprocessor 150. Using the program stored in PROM 154 and configuration data input through the keypad 164, microprocessor 150 controls the motors, valves and heaters of the cryopump, shown generally at 174, through respective drivers, shown generally at 176.

With the three writable memory devices, RAM 156, FLASH memory 158 and EEPROM 160, the system has the fast operating characteristics of a RAM with the secure backup of a FLASH. Also, the data may be retained in the EEPROM 160 with movement of the module; yet the more secure and dynamic operation of the FLASH on the module is obtained.

Figure 8:
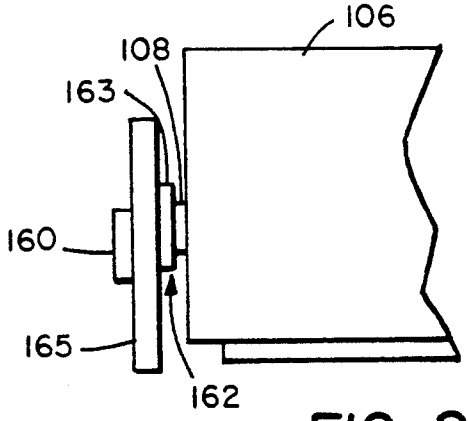
FIG. 8 is a side view of the module to cryopump connector with a PROM mounted to the connector.

FIG. 8 illustrates the connector 162 between the electronics module and the cryopump. It includes connector element 108 on the module 106 and complementary connector 163 on a connector board 165. Also illustrated in FIG. 8 is the EEPROM 160 mounted to the connector board. Thus, it is functionally on the cryopump side of the connector 162 opposite to the electronics module.

Figure 9:
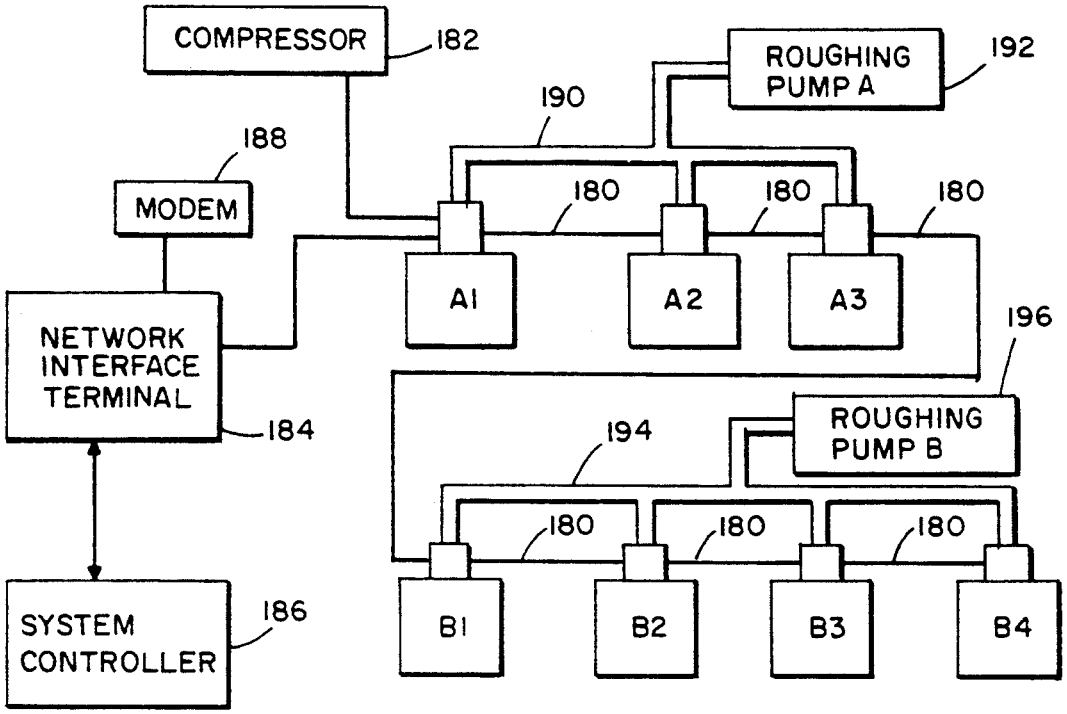
FIG. 9 is a illustration of a network with groups of cryopumps coupled to rough pump manifolds.

FIG. 9 illustrates a network of cryopumps, each as thus far described. Included in the lines 180 joining the cryopumps are the helium lines and power lines for distributing helium and power from a compressor unit 182. Also included in the lines 180 are the SDLC multidrop lines connecting the cryopumps through network communications port 130 and 132.

All network communications are controlled by a network interface terminal which may communicate through an RS 232 port with a system controller 186. While the network interface terminal controls the many cryopumps, the system controller 186 would be responsible for all processing in, for example, a semiconductor fabrication system. The network interface terminal may also communicate with a host computer through a modem 188. Through either the modem 188 or the RS 232 port, the network interface terminal may be used to reconfigure any of the cryopumps connected in the network.

FIG. 9 illustrates seven cryopumps connected in two groups. Cryopumps A1, A2 and A3 are coupled through a manifold 190 to a common rough pump 192. Cryopumps B1, B2, B3 and B4 are coupled through a manifold 194 to a common rough pump 196. With connection of multiple cryopumps to a single rough pump, it is important that no two roughing valves be opened to a common rough pump at one time. Otherwise, the vacuum obtained in one cryopump would be lost as a subsequent cryopump was coupled to the manifold 190. To avoid simultaneous opening of roughing valves to a common rough pump, each cryopump may be inhibited from opening its roughing valve without first obtaining permission from the network interface terminal. Each cryopump may be configured through the user pad or through the network interface terminal to set a roughing valve interlock in software. With that interlock set, when a cryopump reaches the part of the regeneration cycle which requires opening of the roughing valve, opening of the valve is inhibited. The device requests permission from the network interface terminal to open the roughing valve. The valve can not be opened until a token is returned from the network interface terminal. The network interface terminal, on the other hand, only provides one token per group of cryopumps. Until that token is returned by a cryopump it will not forward the token to another one of the group. Preferably the network interface terminal maintains a system map which allows up to five groups of cryopumps, each having up to ten cryopumps. The map may also identify priority of the cryopumps within a group to determine which cryopump receives an available token with multiple requests from the cryopumps of the group.

Figure 10:
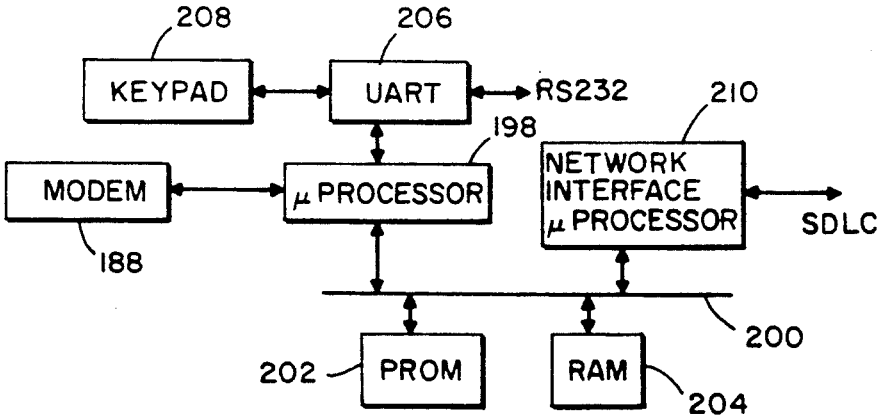
FIG. 10 is a block diagram of the network interface terminal of FIG. 9.

FIG. 10 is a block diagram of the network interface terminal 184. Main processing in the terminal is performed by a microprocessor 198 which may be an Intel 80188 microprocessor. The microprocessor 198 operates on a data bus 200. Also on the bus 200 are the firmware PROM 202 and a RAM 204 which serves as scratch pad memory and also contains the user configuration information. The microprocessor 198 communicates with the modem 188. It also communicates with an RS 232 port through a UART 206. The UART 206 also provides access to the microprocessor 198 from a keypad and display 208. The keypad and display 208 may be identical to that provided on each individual cryopump. Using that keypad, a user may identify an individual cryopump and program that cryopump as it would be programmed directly on a cryopump keypad. Communications to the network of cryopumps is handled by a network interface microprocessor 210 which may be an 8344 processor.

The microprocessor 198 handles programming of individual cryopumps, collection of data from the cryopumps and the roughing valve management as discussed above.

While this invention has been particularly shown and described with references to a preferred embodiment thereof, it will be understood by those skilled in the art that various changes in form and details may be made therein without departing from the spirit and scope of the invention as defined by the appended claims.

We claim:

1. A cryopump system comprising:

a cryopump;

a programmable electronic processor for controlling operation of the cryopump, the electronic processor being mounted in a removable module coupled to the cryopump through a connector; and a nonvolatile memory device coupled to the cryopump, the electronic processor communicating with the memory device through the connector.

2. A cryopump system as claimed in claim 1 wherein the nonvolatile memory device is an electrically erasable and writable PROM.

3. A cryopump as claimed in claim 2 further comprising an electrically erasable and writable PROM on the removable module.

4. A cryopump system as claimed in claim 1 wherein the nonvolatile memory device stores calibration data for the cryopump.

5. A cryopump system as claimed in claim 1 wherein the nonvolatile memory device stores historical data for the cryopump.

6. A cryopump system as claimed in claim 1 wherein the nonvolatile memory device stores regeneration configuration data programmed for the cryopump by a user.

* * * * *